US008511532B2

(12) United States Patent
Chien et al.

(10) Patent No.: US 8,511,532 B2
(45) Date of Patent: Aug. 20, 2013

(54) FASTENER DRIVING TOOL

(75) Inventors: Chia-Yu Chien, Taichung (TW); Chien-Kuo Po, Taichung (TW); Wen-Liang Li, Taichung (TW)

(73) Assignee: Basso Industry Corp., Taichung (TW)

( * ) Notice: Subject to any disclaimer, the term of this patent is extended or adjusted under 35 U.S.C. 154(b) by 62 days.

(21) Appl. No.: 13/093,666

(22) Filed: Apr. 25, 2011

(65) Prior Publication Data

US 2011/0259937 A1 Oct. 27, 2011

(30) Foreign Application Priority Data

Apr. 26, 2010 (TW) ..... 99113090 A

(51) Int. Cl.
*B27F 7/00* (2006.01)

(52) U.S. Cl.
USPC ..... 227/133; 227/131; 227/120

(58) Field of Classification Search
USPC ..... 227/120, 129, 131, 133
See application file for complete search history.

(56) References Cited

U.S. PATENT DOCUMENTS

| | | | | |
|---|---|---|---|---|
| 7,204,403 | B2 * | 4/2007 | Kenney et al. | 227/133 |
| 8,123,099 | B2 * | 2/2012 | Kenney et al. | 227/133 |
| 8,231,039 | B2 * | 7/2012 | Buck et al. | 227/133 |
| 8,302,833 | B2 * | 11/2012 | Gross et al. | 227/134 |
| 2005/0217875 | A1 * | 10/2005 | Forster et al. | 173/1 |
| 2005/0218181 | A1 * | 10/2005 | Gross et al. | 227/130 |

* cited by examiner

*Primary Examiner* — Alexandra Elve
*Assistant Examiner* — Andrew M Tecco
(74) *Attorney, Agent, or Firm* — Holland & Hart LLP

(57) ABSTRACT

A fastener driving tool includes a flywheel rotated by a drive unit and having a wheel rim formed with teeth, an impact member having a mating toothed unit movable with a carrier frame to engage the teeth so as to be swept thereby to an end-stroke position to enable a striking rod to drive a fastener into a targeted workpiece, and an actuating unit configured to actuate the carrier frame to move from an upper position to a lower position in response to a triggering action of a trigger so as to move the mating toothed unit from an disengaging position to an engaging position.

8 Claims, 7 Drawing Sheets

FASTENER DRIVING TOOL

CROSS-REFERENCE TO RELATED APPLICATION

This application claims priority of Taiwanese Patent Application No. 09911309.0, filed on Apr. 26, 2010, the disclosure of which is herein incorporated by reference.

BACKGROUND OF THE INVENTION

1. Field of the Invention

This invention relates to a fastener driving tool, such as a nailer, more particularly to an operational device for a fastener driving tool employing an energized flywheel to perform a fastener driving stroke.

2. Description of the Related Art

In U.S. Patent Application Publication No. US 2005/0218181 A1, there is disclosed a fastening tool includes a backbone, a flywheel pivotally mounted on the backbone, a motor disposed on the backbone to drive rotation of the flywheel, an activation arm pivotally mounted on the backbone, a follower pivotally mounted on the activation arm, and a driver suspendingly disposed between the follower and the flywheel. When the fastening tool is actuated, the motor is activated to drive the flywheel and thereafter to cause an actuator to move the follower so that the follower contacts the driver and the profile of the driver is engaged with an exterior surface of the flywheel with a sufficient clamping force. Kinetic energy can be transferred from the flywheel to the driver to cause the driver to translate and impact a fastener in a nosepiece so that the fastener can be driven into a workpiece.

However, since the driver is suspended and disposed between the follower and the flywheel, when the follower is moved to squeeze the driver into engagement with the flywheel, the driver may deviate from the striking stroke, thereby rendering the fastener driving operation unsteady. Moreover, the fastening tool is complicated in structure and relatively complex in design so that it is expensive to manufacture.

SUMMARY OF THE INVENTION

An object of the present invention is to provide a fastener driving tool which has a simple structure to be easy to manufacture and which can ensure smooth and successful driving of a striking rod.

According to this invention, the fastener driving tool includes a main housing having front and rear ends opposite to each other in a longitudinal direction, and a frame body which is disposed between the front and rear ends. A nosepiece is adapted to be fitted with a magazine, and is disposed forwardly of the front end of the main housing. A striking rod is disposed to be linearly movable along a striking route in the longitudinal direction through the nosepiece for driving a leading one of the fasteners loaded in the magazine, and has a butt end. A flywheel is rotatably mounted on the frame body about a wheel axis that is oriented in a transverse direction transverse to the longitudinal direction, and has a wheel rim formed with teeth. A drive unit is disposed on the frame body, and is coupled to drive the flywheel to rotate about the wheel axis, thereby running the teeth along a cycling path while imparting the teeth with a kinetic energy.

A carrier frame has a pivot end pivotably mounted on the main housing about a pivot axis, a positionable end which is opposite to the pivot end in a lengthwise direction, and which is angularly movable about the pivot axis between upper and lower positions, and a guiding segment which defines a guideway extending in the lengthwise direction. An impact member is disposed on the guiding segment and is movable along the guideway between a ready position and an end-stroke position, and is connected to the butt end of the striking rod to enable the striking rod to drive the fastener when the impact member is forced to dash to the end-stroke position. The impact member has a mating toothed unit configured such that, in the ready position, as a result of displacement of the carrier frame from the upper position to the lower position, the mating toothed unit is moved from a disengaging position to an engaging position where the mating toothed unit is thrust into kinetic contact with the teeth so as to be swept thereby with the kinetic energy that forces the impact member to the end-stroke position. A carrier biasing member is disposed to bias the carrier frame toward the upper position. An actuating unit is configured to actuate the positionable end to move from the upper position to the lower position in response to a triggering action.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
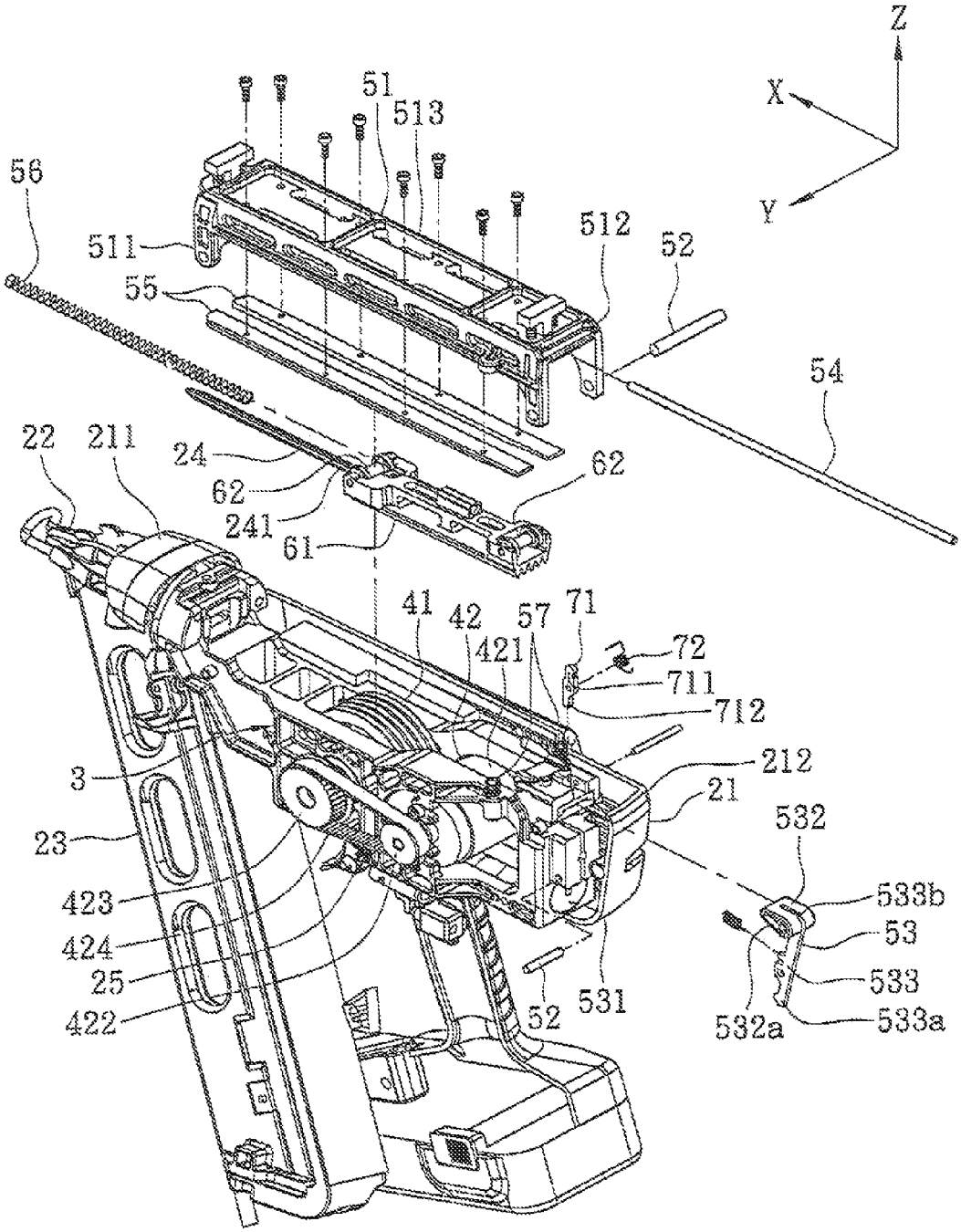
FIG. 1 is an exploded perspective view of the preferred embodiment of a fastener driving tool according to this invention.
Figure 2:
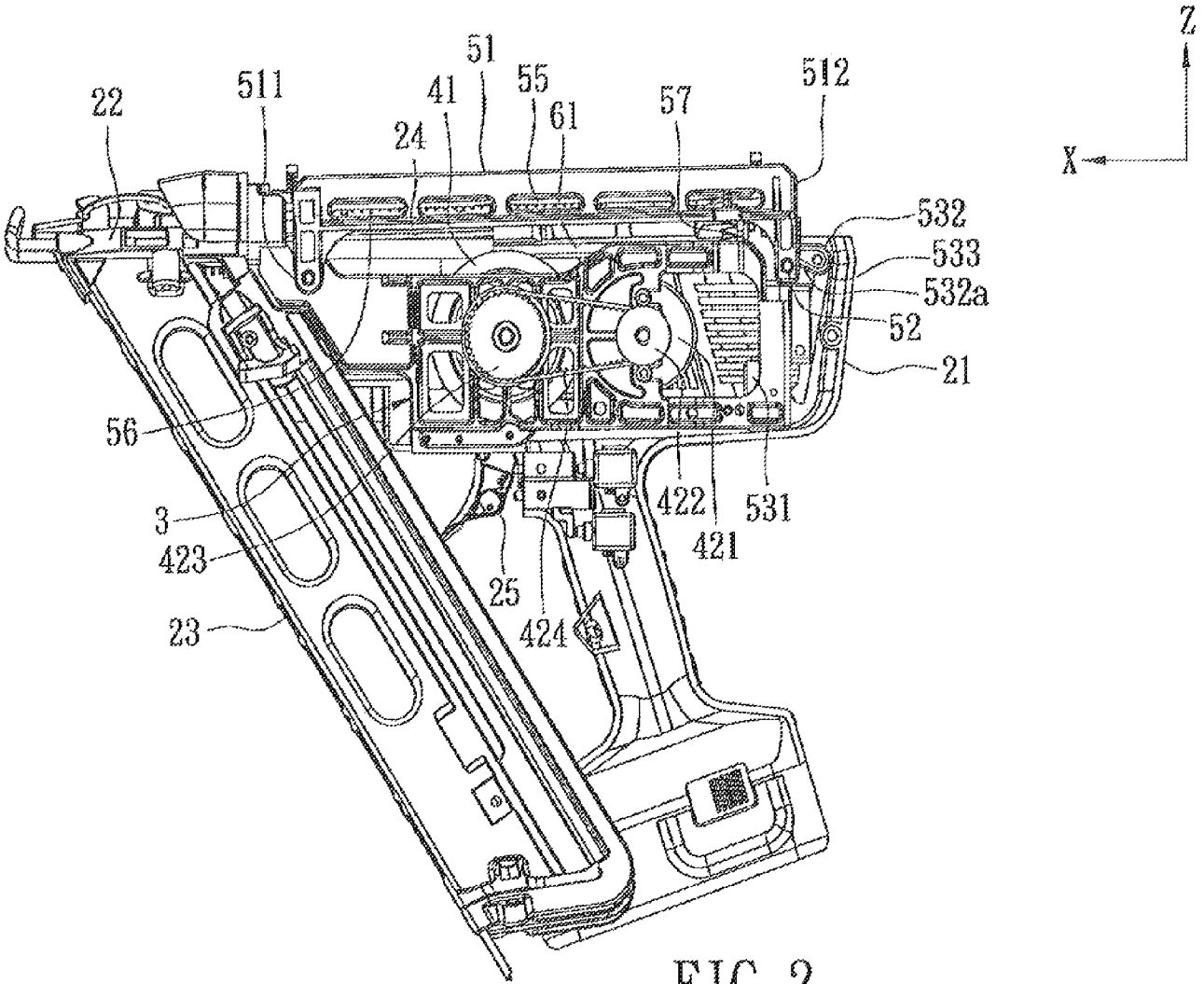
FIG. 2 is a front view of the preferred embodiment.
Figure 3:
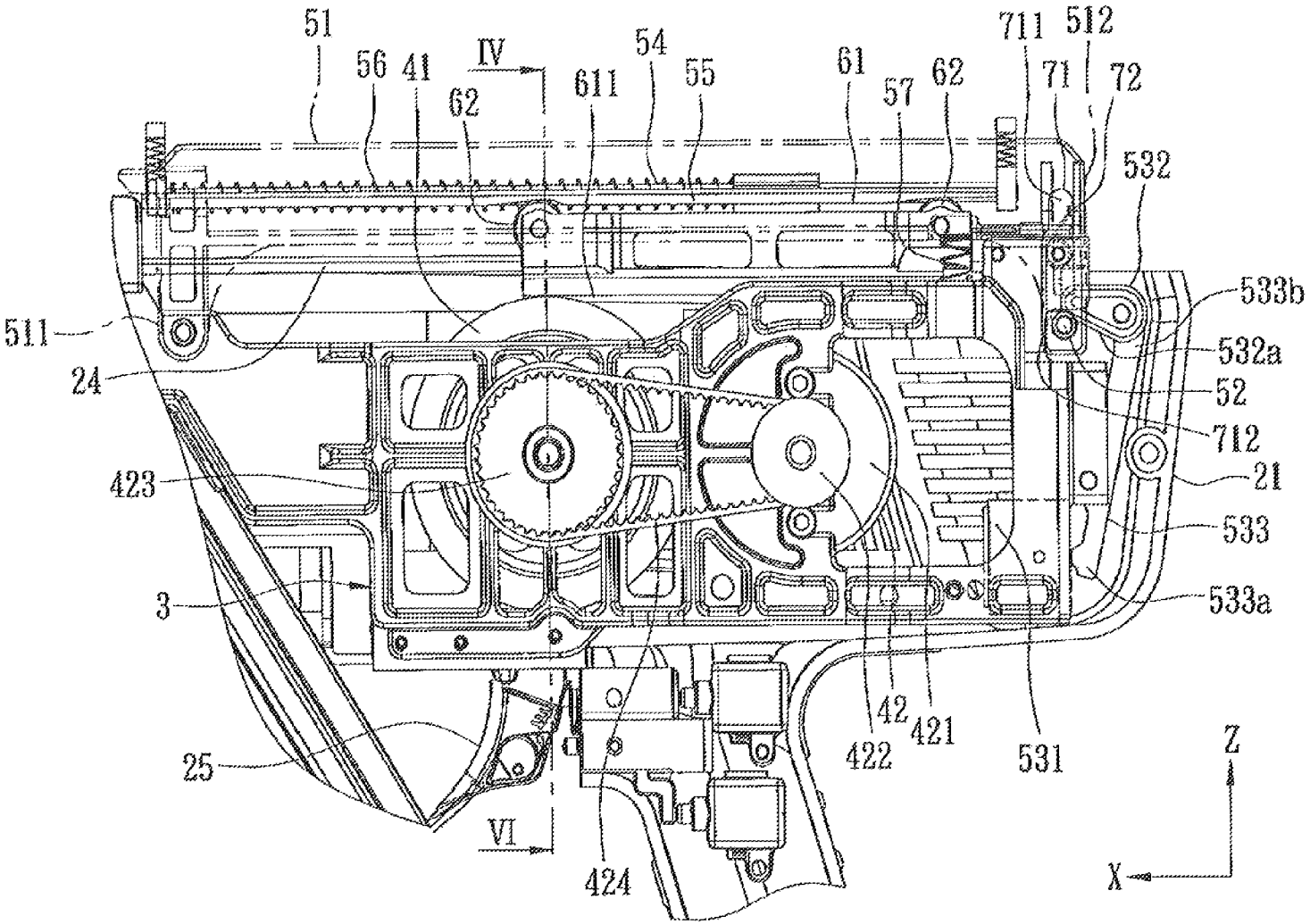
FIG. 3 is a front view of the preferred embodiment in a state of ready to use.

Referring to FIGS. 1 to 3, the preferred embodiment of a fastener driving tool according to the present invention is shown to be a nailer for driving a strip of fasteners, such as nails, staples, etc., loaded in a magazine 23 into a targeted workpiece, and comprise a main housing 21, a nosepiece 22, a striking rod 24, a trigger 25, a flywheel 41, a drive unit 42, a carrier frame 51, an impact member 61, an actuating unit 53, and a counteracting lever 71.

The main housing 21 has front and rear ends 211, 212 opposite to each other in a longitudinal direction (X), and a frame body 3 disposed between the front and rear ends 211, 212. The nosepiece 22 is fitted with the magazine 23 and is disposed forwardly of the main housing 21. The striking rod 24 is disposed to be linearly movable along a striking route in the longitudinal direction (X) through the nosepiece 22 for driving a leading one of the nails and has a butt end 241.

Figure 4:
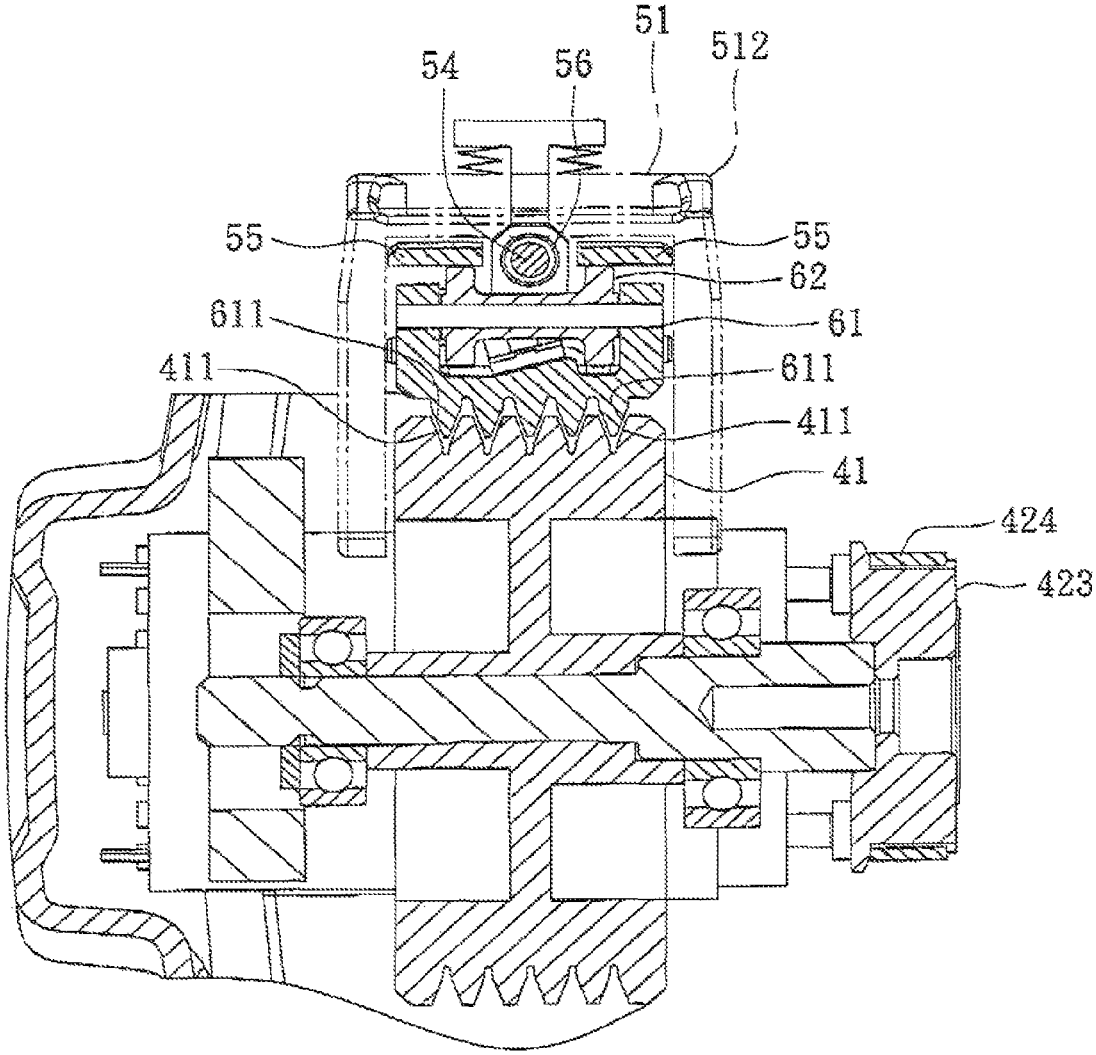
FIG. 4 is a sectional view taken along line IV-IV of FIG. 3.

The flywheel 41 is rotatably mounted on the frame body 3 about a wheel axis that is oriented in a transverse direction (Y) transverse to the longitudinal direction (X), and has a wheel rim which is formed with teeth 411 (as shown in FIG. 4) that are displaced from each other in the transverse direction (Y).

The drive unit 42 is disposed on the frame body 3, and includes a motor 421 which has an output shaft rotatable about a shaft axis parallel to the wheel axis of the flywheel 41, a drive gear 422 coupled for rotation with the output shaft, a transmitting gear 423 coaxially rotatable with the flywheel, and a toothed belt 424 chained on the drive and transmitting gears 422, 423. When the motor 421 is actuated, the flywheel 41 is driven to rotate about the wheel axis, thereby running the teeth along a cycling path while imparting the teeth with a kinetic energy.

The carrier frame 51 has a pivot end 511 pivotably mounted on the front end 211 of the main housing 21 about a pivot axis parallel to the wheel axis of the flywheel 41, a positionable end 512 which is opposite to the pivot end 511 in a lengthwise direction and which is angularly movable about the pivot axis between upper and lower positions, and a guiding segment 513 which has a pair of elongated guiding rails 55 that extend in the lengthwise direction and that are disposed thereon to serve as two guideways. A cam follower 52 is disposed on the positionable end 512, extends in the transverse direction (Y), and is limited by the frame body 3 in an upright direction (Z) to limit an upward movement thereof. A guiding rod 54 is disposed securely on the carrier frame 51 and extends along the striking route. A rod biasing member 56 is disposed to surround the guiding rod 54. A plurality of carrier biasing members 57 are disposed between the rear end 212 of the main housing 21 and the positionable end 512 to bias the carrier frame 51 toward the upper position.

Figure 6:
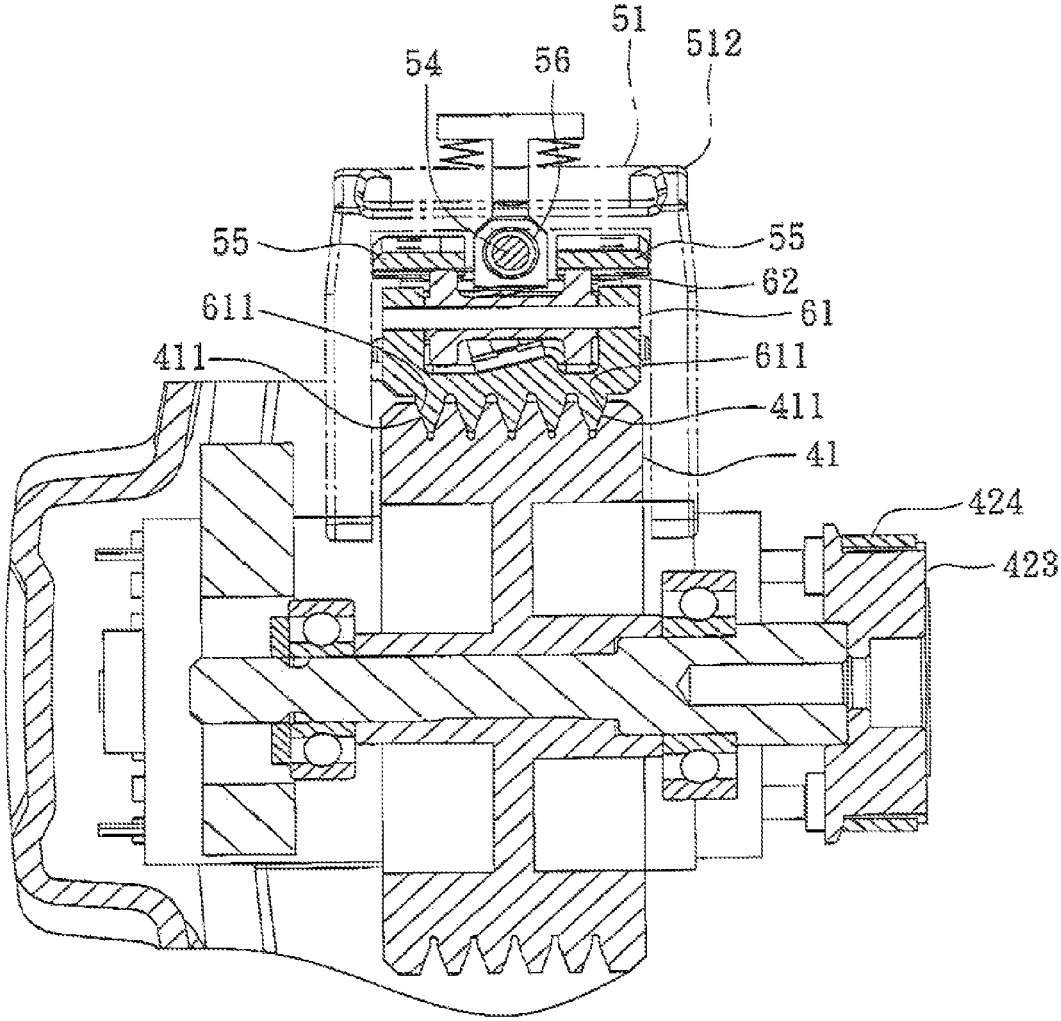
FIG. 6 is a sectional view taken along line VI-VI of FIG. 5.

The impact member 61 is connected to the butt end 241 of the striking rod 24, and is disposed to be slidable along the guiding rod 54 between a ready position and an end-stroke position. When the impact member 61 is forced to dash to the end-stroke position, the striking rod 24 is thrust to drive the nail. The rod biasing member 56 is disposed to bias the impact member 61 to the ready position. The impact member 61 has two rollers 62 disposed to roll on the guiding rails 55, and a mating toothed unit 611 (as shown in FIG. 6) disposed on a bottom side thereof. In the ready position, as a result of displacement of the carrier frame 51 from the upper position to the lower position, the mating toothed unit 611 is moved from a disengaging position to an engaging position where the mating toothed unit 611 is thrust into kinetic contact with the teeth 411 so as to be swept thereby with the kinetic energy that spurs the impact member 61 to the end-stroke position.

Figure 5:
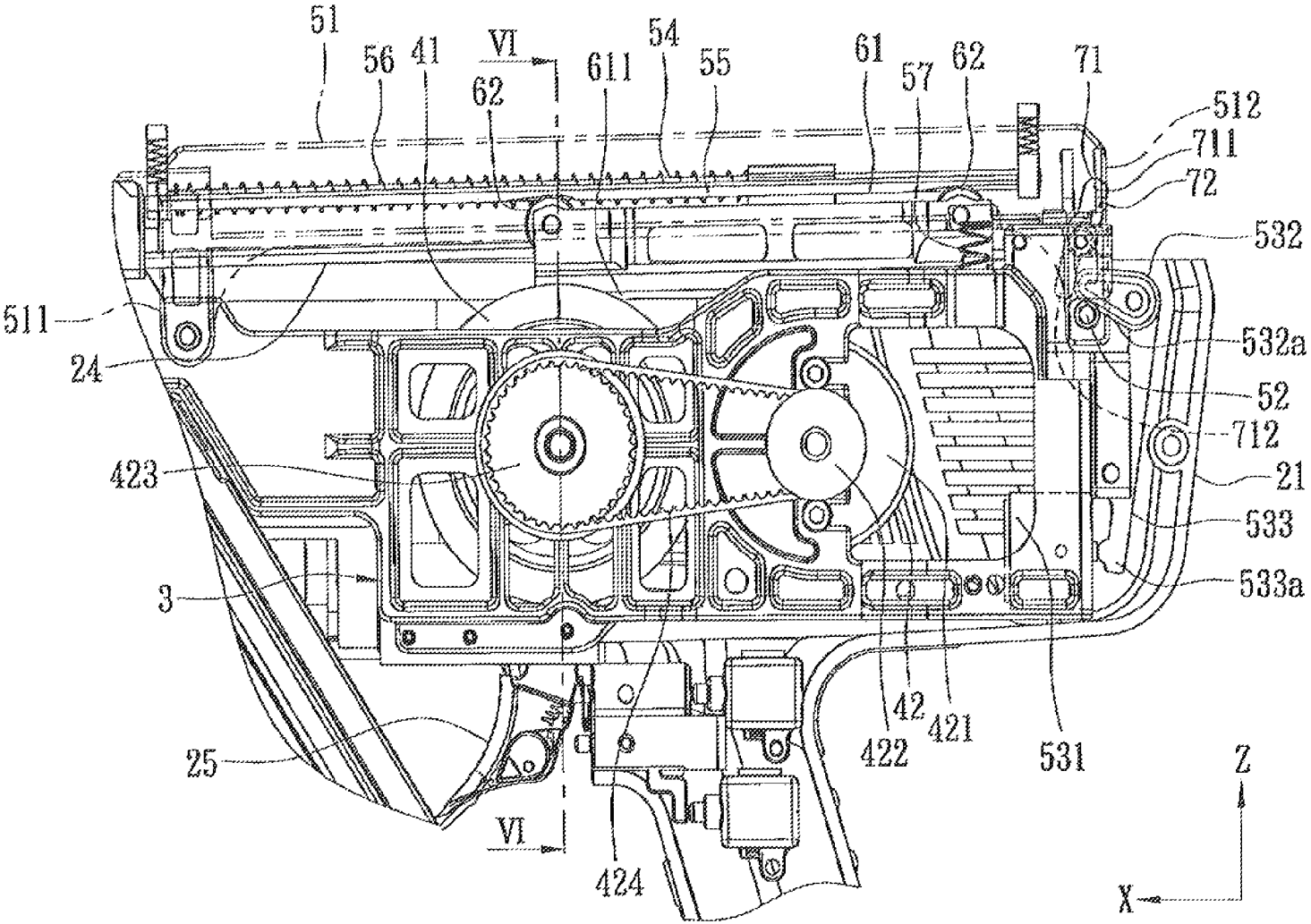
FIG. 5 is a front view showing a carrier frame of the preferred embodiment in a lower position.

The actuating unit 53 includes an actuating lever 533 and a cam member 532. The actuating lever 533 is pivotally mounted on the rear end 212 of the main housing 21, and has a first power end (533*a*) actuated by a plunger of a solenoid 531 as a result of a triggering action of the trigger 25, and a first weight end (533*b*) opposite to the first power end (533*a*). The cam member 532 is pivotally connected to the first weight end (533*b*) of the actuating lever 533, and has a cam surface (532*a*). As shown in FIG. 5, when the first power end (533*a*) of the actuating lever 533 is actuated to move the first weight end (533*b*) from a non-actuating position to an actuating position, by virtue of camming action between the cam surface (532*a*) and the cam follower 52, the positionable end 512 can be displaced to the lower position.

The counteracting lever 71 is pivotally mounted on the rear end 212 of the main housing 21, and has a second power end 712 configured to be actuated by the cam member 532 when the first weight end (533*b*) is moved toward the actuating position, and a second weight end 711 which is disposed to be angularly displaceable between a hooked position (see FIG. 3), where the second weight end 711 is retained to the positionable end 512, and an unhooked position (see FIG. 5), where the second weight end 711 is disengaged from the positionable end 512 to permit movement of the positionable 512 toward the lower position. A lever biasing member 71 is a torsion spring, and is disposed to counteract the second power end 712 against the actuation of the cam member 532 by virtue of biasing the second weight end 711 toward the hooked position, thereby ensuring holding of the positionable end 512 in the upper position.

Referring to FIGS. 1, 3 and 4, in a normal state, the plunger of the solenoid 531 retreats to permit the first weight end (533*b*) of the actuating lever 533 to displace to the non-actuating position where the first weight end (533*b*) is remote from the cam follower 52. At this stage, the positionable end 512 of the carrier frame 51 is held in the upper position by the biasing action of the carrier biasing members 57, and the mating toothed unit 611 of the impact member 61 is in the disengaging position where the mating toothed unit 611 is distant from the teeth 411 of the flywheel 41 by about 0.5 mm.

Meanwhile, the second weight end 711 of the counteracting lever 71 is firmly held in the hooked position by the biasing action of the lever biasing member 72 so as to ensure unmovability of the positionable end 512 in the upper position, thereby preventing any undesirable impact between the mating toothed unit 611 and the teeth 411 due to rumbling of the running motor 421 and spinning-up of the flywheel 41.

When the fastener driving tool is powered on, the motor 421 is actuated to rotate the flywheel 41 through the drive unit 42 to impart the teeth 411 with the kinetic energy.

Figure 7:
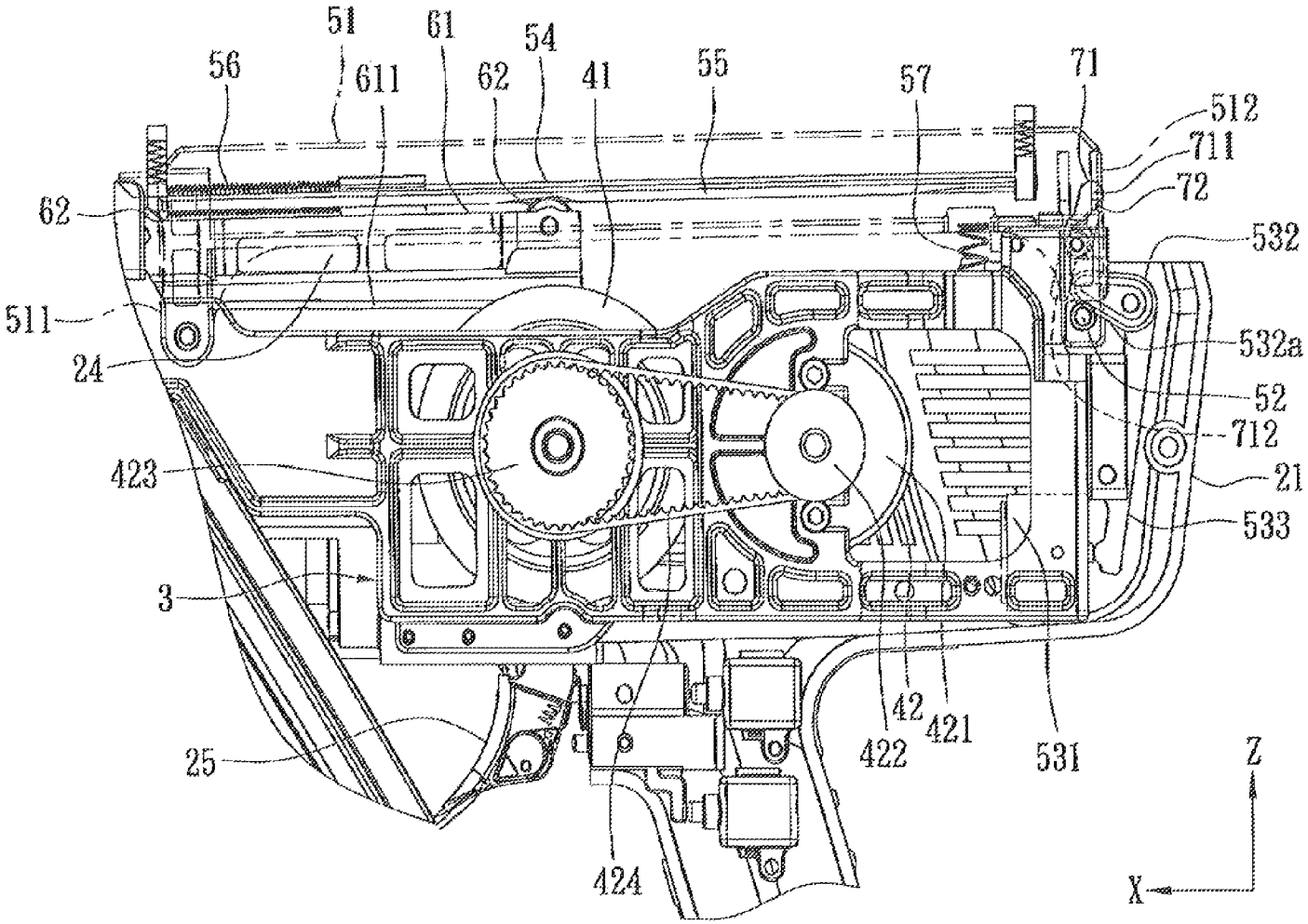
FIG. 7 is a front view of the preferred embodiment in an end-stroke state.

When the trigger 25 is activated, an electromagnetism is caused to drive the plunger of the solenoid 531 to move the actuating lever 533 to the actuating position. As shown in FIGS. 1, 5 and 6, the cam member 532 is moved toward the cam follower 52 to press down the cam follower 52 by virtue of the caroming action, while the second weight end 711 of the counteracting lever 71 is moved by the cam member 532 to the unhooked position against the biasing action of the lever biasing member 72, thereby resulting in a downward movement of the positionable end 512 to the lower position against the biasing action of the carrier biasing members 57. Subsequently, by engagement between the mating toothed unit 611 and the teeth 411, the impact member 61 is swept and forced to the end-stroke position to enable the striking rod 24 to drive the nail into a targeted workpiece, as shown in FIG. 7.

Thereafter, the solenoid 531 is powered off to return to its original position where the actuating lever 533 is moved back to the non-actuating position so that the carrier frame 51 is moved to, the upper position by the biasing action of the carrier biasing members 57 to permit the impact member 61 to be distant from the flywheel 41 by 0.5 mm. The impact member 61 is returned back to the ready position by the biasing action of the rod biasing member 56.

As illustrated, since the impact member 61 is slidably mounted on the carrier frame 51 so as to be moved upwardly and downwardly with the carrier frame 51 relative to the flywheel 41, the striking action of the striking rod 24 is smooth and successful with a relatively great kinetic energy transmitted from the flywheel 42. The assembly and manufacturing of such fastener driving tool of this invention are easier and simplified. Moreover, since the impact member 61, the guiding rod 54 and the rod biasing member 56 are mounted on the carrier frame 51 along the stroke route to be moved with the carrier frame 51, the positioning relation between the impact member 61 and the carrier frame 51 can be reliably ensured so that the kinetic contact between the impact member 61 and the flywheel can be secured at each trigger shot so as to unmistakenly and successfully impart the striking rod with a greater striking force. Furthermore, by guiding movement along the guiding rod 54, and by guiding engagement between the guiding rails 55 and the rollers 62, a linear movement of the impact member 61 along the stroke route can be ensured.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A fastener driving tool for driving a strip of fasteners loaded in a magazine into a targeted workpiece, said fastener driving tool comprising:

a main housing having front and rear ends opposite to each other in a longitudinal direction, and a frame body which is disposed between said front and rear ends;

a nosepiece which is adapted to be fitted with the magazine, and which is disposed forwardly of said front end of said main housing;

a striking rod which is disposed to be linearly movable along a striking route in the longitudinal direction through the nosepiece for driving a leading one of the fasteners, and which has a butt end;

a flywheel rotatably mounted on said frame body about a wheel axis that is oriented in a transverse direction transverse to the longitudinal direction, and having a wheel rim which are formed with teeth;

a drive unit disposed on said frame body, and coupled to drive said flywheel to rotate about the wheel axis, thereby running said teeth along a cycling path while imparting said teeth with kinetic energy;

a carrier frame having a pivot end pivotably mounted on said main housing about a pivot axis, a positionable end which is opposite to said pivot end in a lengthwise direction, and which is angularly movable about the pivot axis between upper and lower positions, and a guiding segment which defines a guideway extending in the lengthwise direction;

an impact member disposed on said guiding segment and movable along said guideway between a ready position and an end-stroke position, and connected to said butt end of said striking rod to enable said striking rod to drive the fastener when said impact member is forced to dash to the end-stroke position, said impact member having a mating toothed unit configured such that, in the ready position, as a result of displacement of said carrier frame from the upper position to the lower position, said mating toothed unit is moved from a disengaging position to an engaging position where said mating toothed unit is thrust into kinetic contact with said teeth so as to be swept thereby with the kinetic energy that forces said impact member to the end-stroke position; a carrier biasing member disposed to bias said carrier frame toward the upper position; and an actuating unit configured to actuate said positionable end to move from the upper position to the lower position in response to a triggering action;

wherein said actuating unit includes an actuating lever which is pivotally mounted on said main housing, and which has a first power end actuated by electromagnetism as a result of the triggering action, and a first weight end coupled to said positionable end such that, when said first power end is actuated to move said first weight end from a non-actuating position to an actuating position, said positionable end is displaced to the lower position.

2. The fastener driving tool according to claim 1, wherein said actuating unit includes a cam member which has a cam surface, and which is pivotably mounted on said first weight end, and a cam follower which is disposed on said positionable end such that, by virtue of caroming action between said cam surface and said cam follower, said positionable end is displaced toward the lower position when said first power end is actuated to move said first weight end toward the actuating position.

3. The fastener driving tool according to claim 2, further comprising: a counteracting lever which is pivotally mounted on said main housing, and which has a second power end that is configured to be actuated by said cam member when said first weight end is moved toward the actuating position, and a second weight end that is disposed to be angularly displaceable between a hooked position, where said second weight end is retained to said positionable end, and an unhooked position, where said second weight end is disengaged from said positionable end to permit movement of said positionable end toward the lower position; and a lever biasing member disposed to counteract said second power end against the actuation of said cam member by virtue of biasing said second weight end toward the hooked position, thereby ensuring holding of said positionable end in the upper position.

4. The fastener driving tool according to claim 1, wherein said actuating unit further includes a solenoid of which a plunger is disposed to actuate said first power end of said actuating lever so as to displace said first weight end to the actuating position.

5. The fastener driving tool according to claim 1, further comprising: a guiding rod which is disposed securely on said carrier frame and which extends along the striking route to permit sliding movement of said impact member therealong; and a rod biasing member which is disposed to surround said guiding rod to bias said impact member to the ready position.

6. The fastener driving tool according to claim 5, further comprising an elongated guiding rail which is disposed on said guiding segment of said carrier frame to serve as said guideway, said impact member having at least one roller which is disposed to roll on said guiding rail.

7. The fastener driving tool according to claim 1, wherein said drive unit includes a motor which has an output shaft rotatable about a shaft axis parallel to the wheel axis, a drive gear coupled for rotation with said output shaft, a transmitting gear coaxially rotatable with said flywheel, and a toothed belt chained on said drive and transmitting gears.

8. The fastener driving tool according to claim 1, wherein said pivot end of said carrier frame is pivotably mounted on said front end of said main housing such that the upper and lower positions of said positionable end are rendered relative to said rear end.

* * * * *